US008693713B2

(12) United States Patent
Chen et al.

(10) Patent No.: US 8,693,713 B2
(45) Date of Patent: Apr. 8, 2014

(54) VIRTUAL AUDIO ENVIRONMENT FOR MULTIDIMENSIONAL CONFERENCING

(75) Inventors: Wei-ge Chen, Sammamish, WA (US); Zhengyou Zhang, Bellevue, WA (US); Yoomi Hur, Sunnyvale, CA (US)

(73) Assignee: Microsoft Corporation, Redmond, WA (US)

( * ) Notice: Subject to any disclaimer, the term of this patent is extended or adjusted under 35 U.S.C. 154(b) by 430 days.

(21) Appl. No.: 12/970,964

(22) Filed: Dec. 17, 2010

(65) Prior Publication Data

US 2012/0155680 A1 Jun. 21, 2012

(51) Int. Cl.
*H04R 5/02* (2006.01)

(52) U.S. Cl.
USPC ..... 381/306; 381/14.08; 381/E07.083; 381/77

(58) Field of Classification Search
USPC ..... 381/91–92, 122, 77, 17, 309–310, 306; 348/14.08, E7.083
See application file for complete search history.

(56) References Cited

U.S. PATENT DOCUMENTS

| | | | | |
|---|---|---|---|---|
| 6,894,714 | B2 | 5/2005 | Gutta et al. | |
| 7,346,654 | B1 | 3/2008 | Weiss | |
| 8,263,848 | B2 * | 9/2012 | Aspland | 84/415 |
| 8,391,508 | B2 * | 3/2013 | Lokki et al. | 381/92 |
| 8,411,126 | B2 * | 4/2013 | Lee et al. | 348/14.01 |
| 8,559,646 | B2 * | 10/2013 | Gardner | 381/63 |
| 2003/0007648 | A1 | 1/2003 | Currell | |
| 2004/0223620 | A1 * | 11/2004 | Horbach et al. | 381/59 |
| 2006/0171547 | A1 * | 8/2006 | Lokki et al. | 381/92 |
| 2008/0304670 | A1 | 12/2008 | Breebaart | |
| 2009/0080632 | A1 | 3/2009 | Zhang et al. | |
| 2009/0237492 | A1 | 9/2009 | Kikinis et al. | |
| 2009/0262947 | A1 | 10/2009 | Karlsson et al. | |
| 2011/0103624 | A1 * | 5/2011 | Ferren | 381/306 |

OTHER PUBLICATIONS

Zhou et al., "The Role of 3-D Sound in Human Reaction and Performance in Augmented Reality Environments", Retrieved at << http://ieeexplore.ieee.org/stamp/stampjsp?tp=&arnumber=4100785 >>, IEEE Transactions on Systems, Man, and Cybernetics—Part A: Systems and Humans, vol. 37, No. 2, Mar. 2007.

Moore, F. Richard , "A General Model for Spatial Processing of Sounds", Computer Music Journal, vol. 7, No. 3, 1983, p. 6-15.

* cited by examiner

*Primary Examiner* — Disler Paul
(74) *Attorney, Agent, or Firm* — Bryan Webster; Andrew Sanders; Micky Minhas

(57) ABSTRACT

The disclosed architecture employs signal processing techniques to provide audio perception only, or audio perception that matches the visual perception. This also provides spatial audio reproduction for multiparty teleconferencing such that the teleconferencing participants perceive themselves as if they were sitting in the same room. The solution is based on the premise that people perceive sounds as a reconstructed wavefront, and hence, the wavefronts are used to provide the spatial perceptual cues. The differences between the spatial perceptual cues derived from the reconstructed wavefront of sound waves and the ideal wavefront of sound waves form an objective metric for spatial perceptual quality, and provide the means of evaluating the overall system performance. Additionally, compensation filters are employed to improve the spatial perceptual quality of stereophonic systems by optimizing the objective metrics.

20 Claims, 8 Drawing Sheets

VIRTUAL AUDIO ENVIRONMENT FOR MULTIDIMENSIONAL CONFERENCING

BACKGROUND

The demand for teleconferencing systems continues to steadily increase due to the importance placed on such technology in business and personal use. In 3-dimensional (3D) video conferencing, a user visually perceives a shared 3D space with the remote participants. The shared space can take the form of virtual space augmented from the physical space the user occupies. Correspondingly, the audio signal needs to match the visual perception. This applies even without a video component to the conferencing system. For example, if a video wall shows the other party on the other side of the wall, the voice signals of the other party should be perceived as coming from the other side as well. For different remote participants, voices should be perceived as though originating from distinct locations of the remote participants is located in the visual scene. That is, when the remote participant moves around, the audio signal should also match (follow) the remote participant movement.

While spatial audio has shown promise in improving the listener experience of conferencing audio, reproducing spatial audio realistically remains a significant challenge with a limited (small) number of loudspeakers. In many situations where there is more than one local participant, it is necessary to reproduce the audio using loudspeakers. Practical systems comprising a few loudspeakers, known as stereophonic systems, suffer a sweet spot problem where the accurate production of spatial audio is only possible over a very small area. Notwithstanding that in certain situations where the total number of participants is limited such that each remote participant can be assigned to an individual loudspeaker, the speakers are typical non-movable. Thus, when a remote participant (listener) moves even slightly, the sound image becomes unstable. Moreover, this approach does not scale well to typical situations where the number of participants exceeds the number of loudspeakers.

SUMMARY

The following presents a simplified summary in order to provide a basic understanding of some novel embodiments described herein. This summary is not an extensive overview, and it is not intended to identify key/critical elements or to delineate the scope thereof. Its sole purpose is to present some concepts in a simplified form as a prelude to the more detailed description that is presented later.

The disclosed architecture overcomes the sweet spot limitations of conventional systems by employing signal processing techniques to provide the audio perception that matches the visual perception. This also provides spatial audio reproduction for multiparty teleconferencing such that the participants perceive themselves as if all sitting on the same room. The solution is based on the premise that people perceive sounds as a reconstructed wavefront, and hence, the wavefronts are used to provide the spatial perceptual cues. By aiming at the perceptual cues, the matching wavefront is relaxed somewhere, and hence, is more achievable. This is in contrast to wave field analysis techniques that attempt to match the wavefront everywhere. The differences between the spatial perceptual cues derived from the reconstructed wavefront of sound waves and the "ideal" wavefront of sound waves form an objective metric for spatial perceptual quality, and provide the means of evaluating the overall system performance. Additionally, compensation filters are employed to improve the spatial perceptual quality of stereophonic systems by optimizing the objective metrics.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
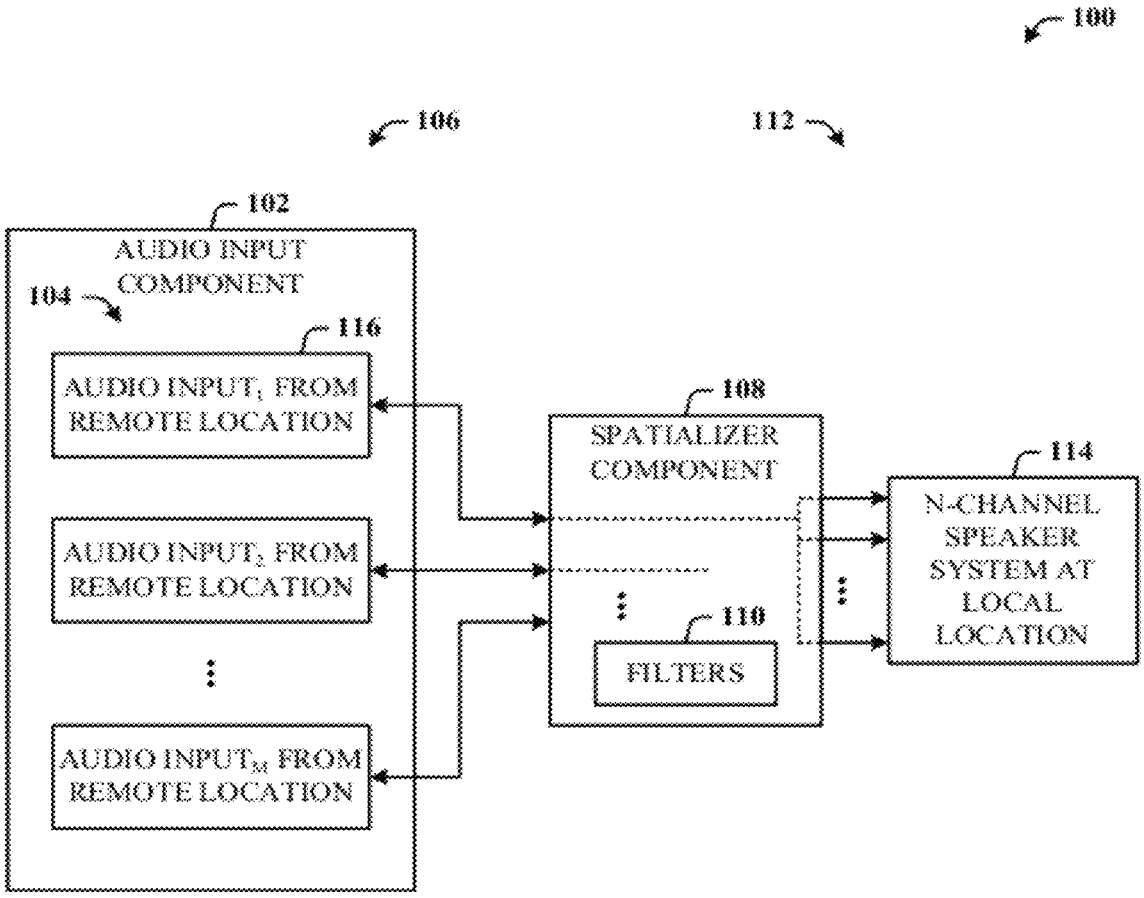
FIG. 1 illustrates a multiparty media processing system in accordance with the disclosed architecture.

The disclosed architecture focuses on "correcting" the spatial perceptual cues in a room being utilized for conferencing and is not concerned with loudspeaker or local room responses. The architecture utilizes signal processing techniques to improve spatial audio reproduction for multiparty teleconferencing. The architecture incorporates both the physical aspect of sound propagation and the psychoacoustical aspect of human auditory perception, covering the complete pathway from the source to the binaural cues. It is assumed that the room XY dimensions (length and width) are known. The Z (height) dimension can be treated in the same fashion as the XY dimensions. Moreover, the description is based on direct paths rather than reflective paths. However, the consideration of reflective sound paths is within contemplation of the disclosed architecture, but involves additional analysis and acoustic properties. Based on this understanding, the feasibility is shown of an optimal stereophonic sound reproduction in the context of multiparty conferencing. The architecture effectively reduces the perceptual error significantly beyond the sweet spot that limits traditional audio spatialization techniques.

The description discloses an objective evaluation model for the spatial sound perception. People perceive sounds as a reconstructed wavefront, and hence, the wavefronts are used to provide the spatial perceptual cues. The differences between the spatial perceptual cues derived from the reconstructed wavefront and the "ideal" wavefront form an objective metric for spatial perceptual quality, and provide for means of evaluating the overall system performance. Subsequently, compensation filters are introduced to improve the spatial perceptual quality of stereophonic systems based on the proposed objective metric. The compensation filters are computed, and can then be applied in or near realtime to map the audio signal to the target auditory environment.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

FIG. 1 illustrates a multiparty media processing system 100 in accordance with the disclosed architecture. The system 100 includes an audio input component 102 that receives electrical signals representative of audio from audio sources 104 positioned at a remote location 106. The system 100 also includes a spatializer component 108 that applies compensation filters 110 to the electrical signals to construct sound waves via speakers at a local location 112. The speakers are part of an N-channel speaker system 114 at the local location 112. The sound waves provide spatial perception cues of a position of an audio source 116 at the remote location 106 to listeners at the local location 112. The audio sources 104 can include audio sensors (e.g., microphones) that receive audio from talkers (conferencing participants) and convert the audio (speech) into the electrical signals and transmit the signals to audio processing subsystems for communication (e.g., analog, digital, etc.) to the local location 112.

The compensation filters 110 are computed to consider a frequency dependent reconstructed signal at each listener position. The compensation filters 110 are computed to consider perceptual error between an ideal wavefront (of sound waves) and a reconstructed wavefront (of sound waves) relative to a given listener position. A set of the compensation filters 110 is computed for each audio source for all local listener positions and a listener perceives a virtual location of the audio source based on the compensation filters. The spatializer component 108 quantifies perceptual error for a given listener position. In other words, the perceptual error is quantified as the difference between the reconstructed wavefront and an ideal wavefront. The compensation filters 110 are computed to consider binaural perception cues determined from at least one of an interaural time difference or an interaural level difference. The spatializer component 108 facilitates modification of a feeding gain and delay for a local speaker to reconstruct the sound waves for a given listening position.

Figure 2:
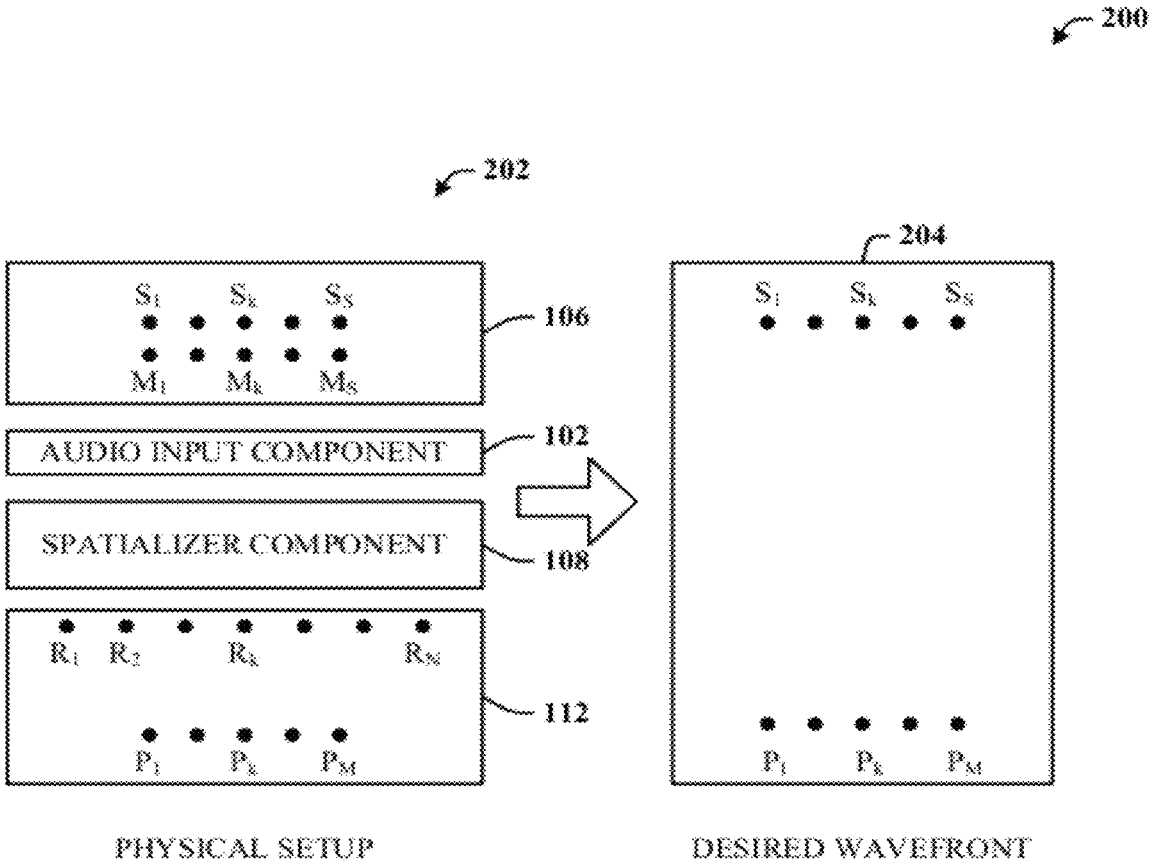
FIG. 2 illustrates a diagram of a physical setup and a desired wavefront obtained by spatialization for an audio system.

FIG. 2 illustrates a diagram 200 of a physical setup 202 and a desired wavefront 204 obtained by spatialization for an audio system. The physical setup 202 includes the remote location 106 with talker positions $S_S$ from which talkers speak into corresponding audio input devices such as microphones $M_S$, which are positioned in the remote location 106. Thus, a first talker at a position $S_1$ speaks into a first microphone $M_1$, and so on. The audio input component 102 can include the microphones $M_S$ or receive only signals from the microphones $M_S$. Moreover, the audio input component 102 can be part of the remote location 106 and facilitates communication of the signals to the spatializer component 108 at the local location 112.

The local location 112 comprises audio speakers $R_N$ and listeners $P_M$. The spatializer component 108 applies the filters to the signals to construct the wavefronts that provide spatial audio perception cues to each of the listeners $P_M$ of the position in the 3D space of a talker (e.g., the first talker at position or site $S_1$) of the remote location 106. The spatializer component 108 provides the impression to the participants (e.g., of a video conference) that the talkers and listeners are in the same room and can thus, the listeners can perceive the location of a talker.

Following is a description of an exemplary stereophonic sound perception model for providing audio spatialization such as for multiparty teleconferencing. In a first part, individual sound waves from each loudspeaker are combined to form a complex wavefront at each ear of a listener. In a second part, the spatial perceptual cues such as ITD (interaural time difference) and/or ILD (interaural level difference) are computed from the information of the wavefronts. These can be performed at each frequency bin.

With respect to wavefront construction, consider one participant at a site S (also referred to as a talker position) whose voice is virtualized at virtual source $V=(x_v, y_v)$. Consider the incoming signal from site S to be s(t; f) as a single frequency sinusoidal signal at f. Broadband signals can also be handled.

Assume N loudspeakers are located at positions $R_i=(x_{ri}, y_{ri})$, i=1, . . . , N at the local location 112. Each loudspeaker signal can be obtained as $w_i(t; f)=g_{vi}\cdot s(t-t_{vi}; f)$, where the feeding gain $g_{vi}$ and delay $t_{vi}$ at i-th loudspeaker are, $$g_{vi} = \frac{1}{\|V - R_i\|} \text{ and } t_{vi} = \frac{\|V - R_i\|}{c} \tag{1}$$

where c is the speed of sound. In this example, consideration is limited to the direct path only. It is straightforward to generalize the formulation to include reflections.

At a particular listening position $P=(x_p, y_p)$, the frequency-dependent reconstructed signal $w(t, x_p, y_p; f)$ is as follows with a propagating attenuation $g_i^p$ and delay $t_i^p$ determined similarly as in Equation (1).

$$w(t, x_p, y_p; f) = \sum_{i=1}^{N} g_i^p \cdot w_i(t - t_i^p; f) \tag{2}$$

When considering what happens at each human ear, the frequency-dependent wavefront incident angle is extracted from wavefront signal w(t, x, y; f) at a particular point in space, as follows:

$$\theta(t, w; f) = \arctan\left(\frac{\frac{\partial w}{\partial y}}{\frac{\partial w}{\partial x}}\right) \tag{3}$$

Let the listener's left (l) and right (r) ear positions be $P_l=(x_{pl}, y_{pl})$ and $P_r=(x_{pr}, y_{pr})$, respectively. The incident angle at each ear is denoted as $\theta_L(t, w; f)$ and $\theta_R(t, w; f)$.

Furthermore, the well-known practice of binaural perception and accounting for the effect of human head, body, and outer ear is followed using the time domain version of the head-related transfer function (HRTF), denoted as HRIR (head related impulse response). However, the propagation delay that is typically included in the acquisition of HRTF is excluded, as the wavefront data already includes such delay.

Hence, the minimum phase version of HRIR associated with the particular incidence angle and generate inner ear signal is used as follows:

$$e_L(t,x_{pl},y_{pl};f)=h_L(\theta_L(t,w;f))*w(t,x_{pl},y_{pl};f)$$

$$e_R(t,x_{pr},y_{pr};f)=h_R(\theta_R(t,w;f))*w(t,x_{pr},y_{pr};f), \quad (4)$$

where $h_L(\theta_L)$ and $h_R(\theta_R)$ are the minimum phase version of left and right channel HRIR for angle $\theta_L$ and $\theta_R$, respectively.

Figure 3:
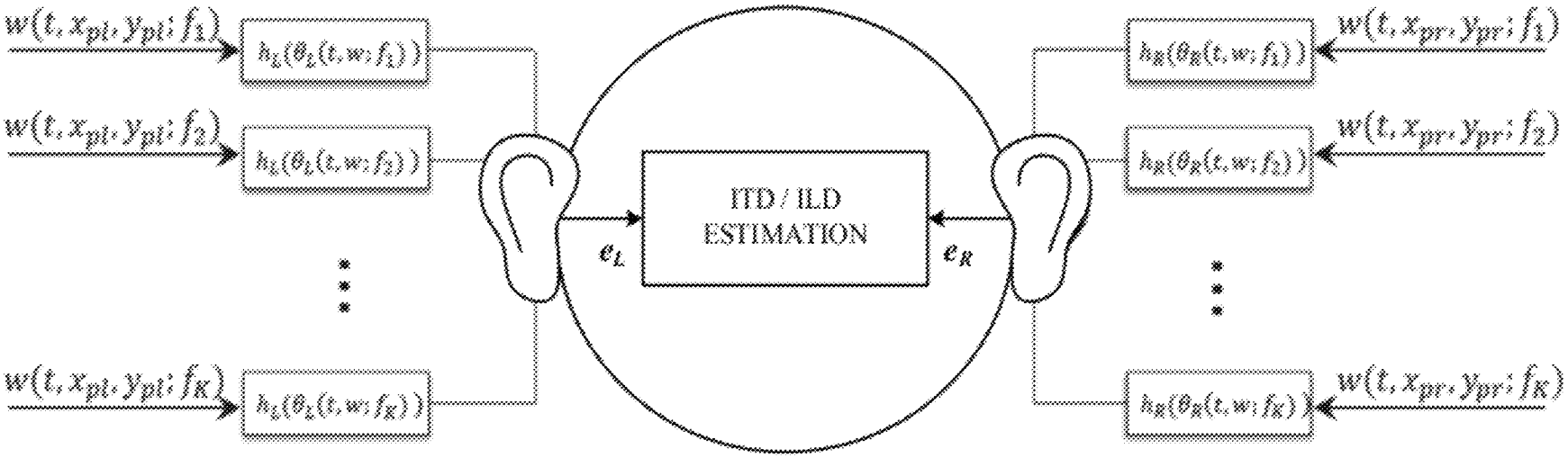
FIG. 3 illustrates a process for interaural difference estimation.

Once the inner ear signal is obtained, the binaural perceptual cues are calculated such as ITD and ILD, which in turn predict where the perceived source (talker) will be. FIG. 3 illustrates a process 300 for interaural difference estimation. Thus far, only a single frequency signal has been considered. Since human auditory system perceives sound at the critical band level, the localization cues are calculated at each critical band from the integrated signal within the critical band. In other words, signal is first integrated within each critical band, and then the cues for each critical band are calculated from the integrated signal. A critical band is the smallest resolution for human perception. Every frequency that falls in the critical band is indistinguishable to the human ear (e.g., approximately 20-40 critical bands in the frequency range of 20-20 KHz). For each critical band is derived an optimal gain/delay for each loudspeaker. Furthermore, since it is known that human ears have a limited time resolution, reasonable time-domain smoothing is also introduced.

The perceptual error in a particular listening position can now be quantified. Using simplified notation, consider a particular binaural cue q(w; P, V, $f_{cb}$) where, again, P is the position of the listener and V is the position of the virtual source (or talker), w is the reconstructed wavefront, and $f_{cb}$ denotes a particular critical band. Consider that the virtual positions are now "real" and the loudspeakers are replaced with open space. In terms of spatial sound perception, this represents the ideal situation (the ideal result (or wavefront) 204 of FIG. 2). Following the similar formulation as above, the ideal inner ear signal can be calculated, and hence, the ideal binaural perceptual cue $q_o(P, V, f_{cb})$. Note that the ideal cue does not have any dependency on the reconstructed wavefront, as the loudspeakers are now irrelevant.

In other words, the below serves as an indicator of perceptual discrepancy between the reconstructed wavefront and the ideal wavefront:

$$E(q,q_o)=\int_p(q(w;P,V,f_{cb})-q_o(P,V,f_{cb}))^2, \quad (5)$$

where the error term is integrated over a range of listening positions P. There are a number of choices of error metric; however, the mean squared error is selected in this example, for its simplicity.

Recall that from Equation (2) that for a fixed virtual source position V, w is a function of a propagating attenuation $g_i^p$ and delay $t_i^p$. If introducing additional gain (attenuation) and delay, w can be modified, and in turn, the perceptual error as defined in Equation (5). Let the compensated signal be, $$w_c(t, x_p, y_p; f) = \sum_{i=1}^{N} G_{if_{cb}}^V g_i^p \cdot w_i(t - t_i^p - T_{if_{cb}}^V; f), \quad (6)$$

where $G_{if_{cb}}{}^V$ and T-hd $if_{cb}{}^V$ are the additional gain and delay, respectively, for a fixed virtual source V at the i-th loudspeaker and at critical band $f_{cb}$. The perceptual error $E(q_c, q_o)$ follows from Equation (5), where $q_c$ denotes the binaural cue computed from $w_c$.

The optimal compensation filter $H_i{}^V(f_{cb})$, for a fixed virtual source position V and i-th loudspeaker, is the set of $G_{if_{cb}}{}^V$ and $T_{if_{cb}}{}^V$ that minimizes the perceptual error, namely, $$H_i^V(f_{cb}) = \arg\min_{G_{if_{cb}}^V,\, T_{if_{cb}}^V} E\left(q_c\left(G_{if_{cb}}^V, T_{if_{cb}}^V\right), q_o\right) \quad (7)$$

The term $f_{cb}$ is moved away from the subscript to follow the common notation for digital filters. The optimal coefficient for each critical band can be solved and applied independently.

Figure 4:
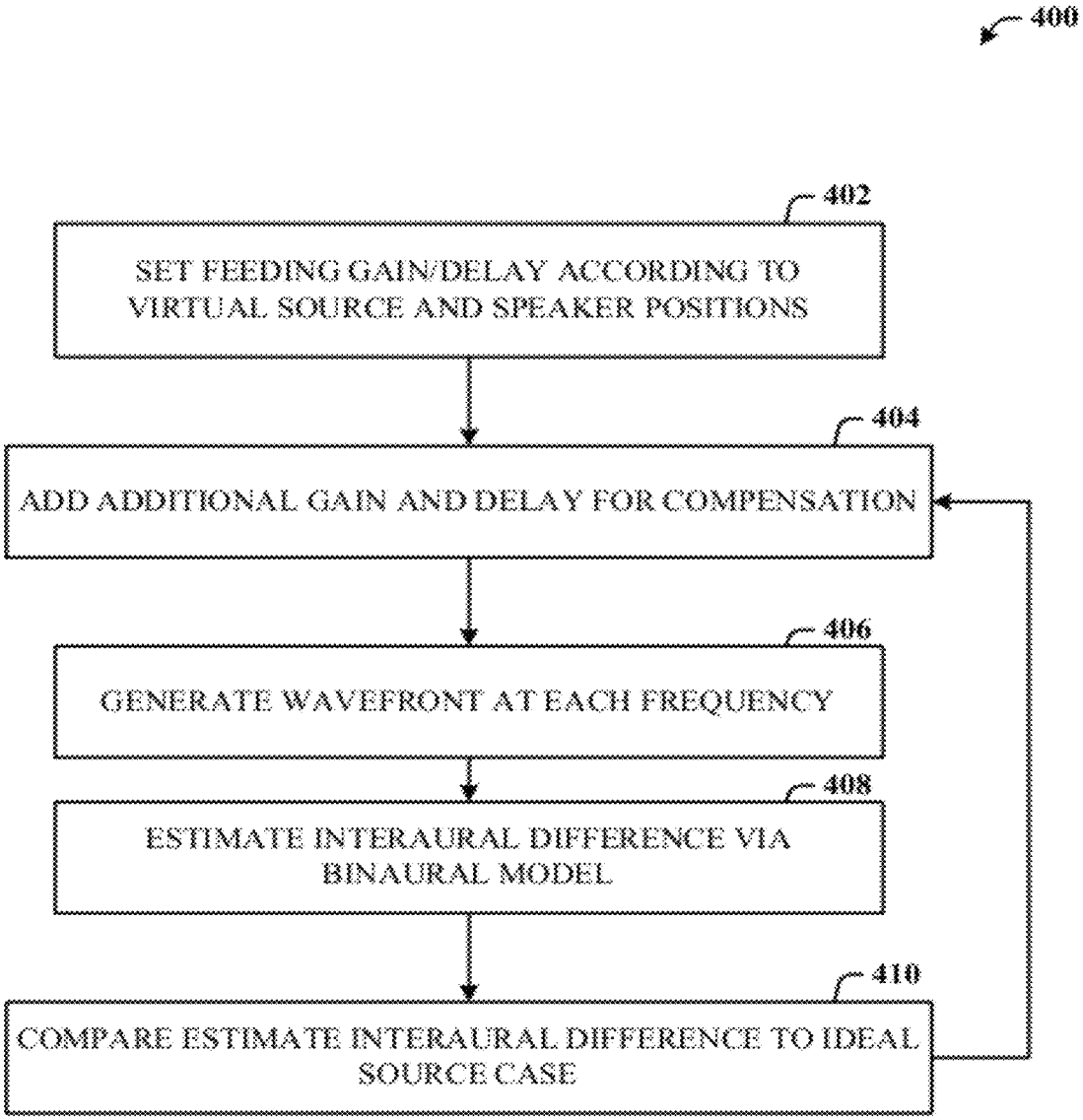
FIG. 4 illustrates an evaluation model with compensation filter.

FIG. 4 illustrates an evaluation model 400 with compensation filter. At 402, the feeding gain and delay can be set according to the virtual source and speaker positions. At 404, additional gain and delay can be added for compensation. At 406, a wavefront is generated at each frequency. At 408, the interaural difference (e.g., ITD) is estimated via the binaural model. At 410, the estimated interaural difference is compared to the ideal source case. Flow is then back to 404 to adjust (e.g., add) the gain/delay for compensation.

Figure 5:
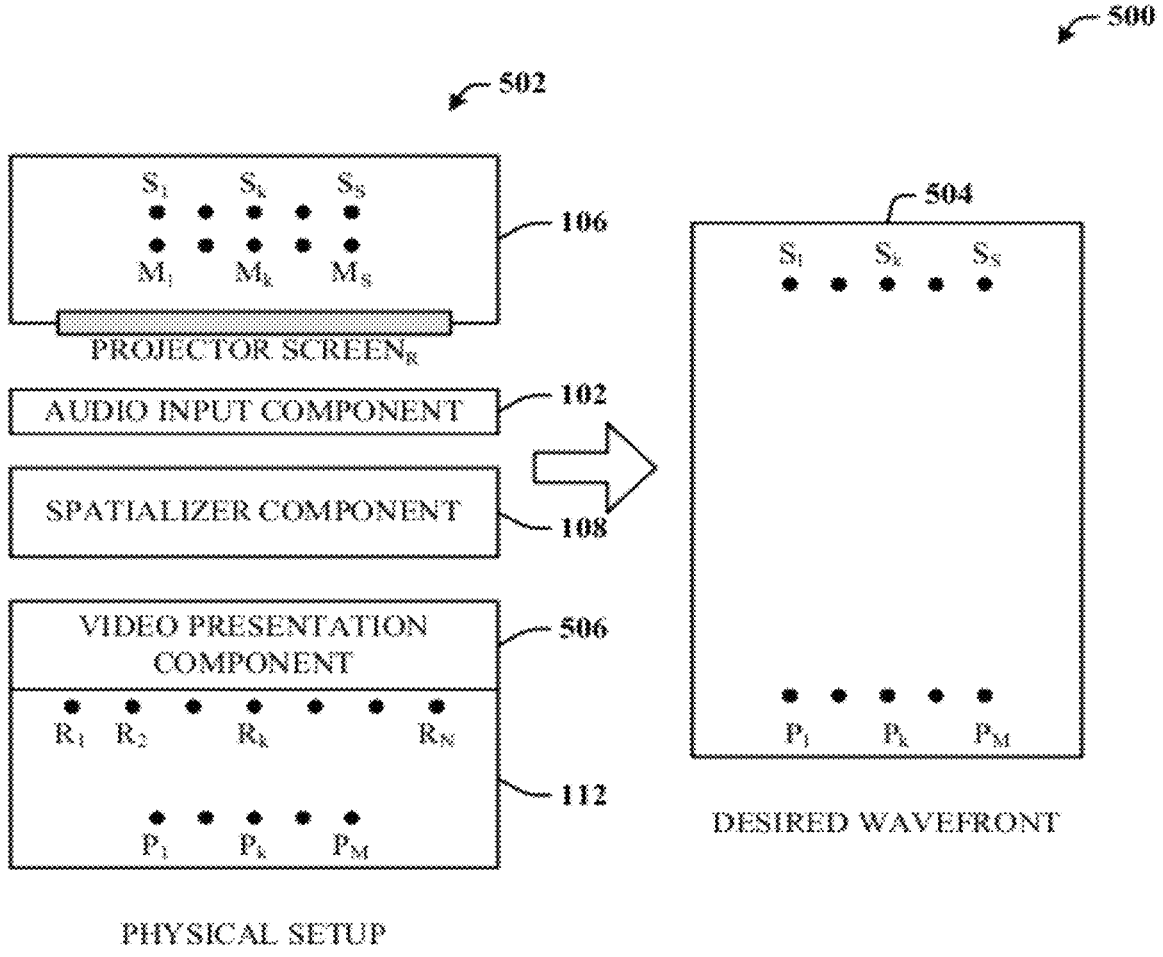
FIG. 5 illustrates a diagram of a physical setup and a desired wavefront obtained by spatialization for an audio/video perception system in accordance with the disclosed architecture.

FIG. 5 illustrates a diagram 500 of a physical setup 502 and a desired wavefront 504 obtained by spatialization for an audio/video perception system in accordance with the disclosed architecture. The physical setup 502 includes the remote location 106 with talker positions $S_S$ from which talkers speak into corresponding audio input devices such as the microphones $M_S$. The audio input component 102 can include the microphones $M_S$ or receive only signals from the microphones $M_S$. Moreover, the audio input component 102 can be part of the remote location 106 and facilitates communication of the signals to the spatializer component 108 at the local location 112.

The physical setup 502 of the audio/video system further comprises a video presentation component 506 (e.g., a projector screen, display, video display, etc.) that renders images of talkers captured at the remote location, the images rendered to the listeners at the local location to provide a video perception to the listeners. The spatializer component 108 maps the audio perception to the video perception in 3D space, including depth of an audio source.

In a conference room implementation for teleconferencing remote talkers communicate with local listeners. Each team is sitting in its respective conference room. The configuration for each conference room can include a projection screen, an array of speakers, and an array of microphones (one microphone per talker, and the microphone could be virtual through array microphone beam-forming).

The spatialization component 108 creates the impression for each team that they are in one large combined conference room (while actually sitting in respective conference rooms), thereby simulating visual immersion and aural immersion.

Put another way, a multiparty media processing system is provided that comprises an audio input component that receives electrical signals representative of audio from talkers speaking into audio sources positioned at a remote location, a spatializer component that applies compensation filters to the electrical signals to construct sound waves via loudspeakers at a local location, the sound waves provide spatial perception cues of a position of an audio source at the remote location to listeners at the local location, and a video presentation component that renders images of talkers captured at the remote location, the images rendered to the listeners at the local location to provide a video perception to the listeners, the spatializer component relates the audio perception to the video perception in 3D space, including depth of an audio source, via the compensation filters.

The compensation filters are computed to consider perceptual error between an ideal wavefront and a reconstructed wavefront relative to a given listener position. The compensation filters are computed to consider binaural perception cues determined from at least one of an interaural time difference or an interaural level difference. A compensation filter is optimized based on perceptual modeling of the local location for all local listener positions. The spatializer component facilitates modification of a feeding gain and delay for a local speaker to reconstruct the sound waves for a given listening position.

Included herein is a set of flow charts representative of exemplary methodologies for performing novel aspects of the disclosed architecture. While, for purposes of simplicity of explanation, the one or more methodologies shown herein, for example, in the form of a flow chart or flow diagram, are shown and described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology could alternatively be represented as a series of interrelated states or events, such as in a state diagram. Moreover, not all acts illustrated in a methodology may be required for a novel implementation.

Figure 6:
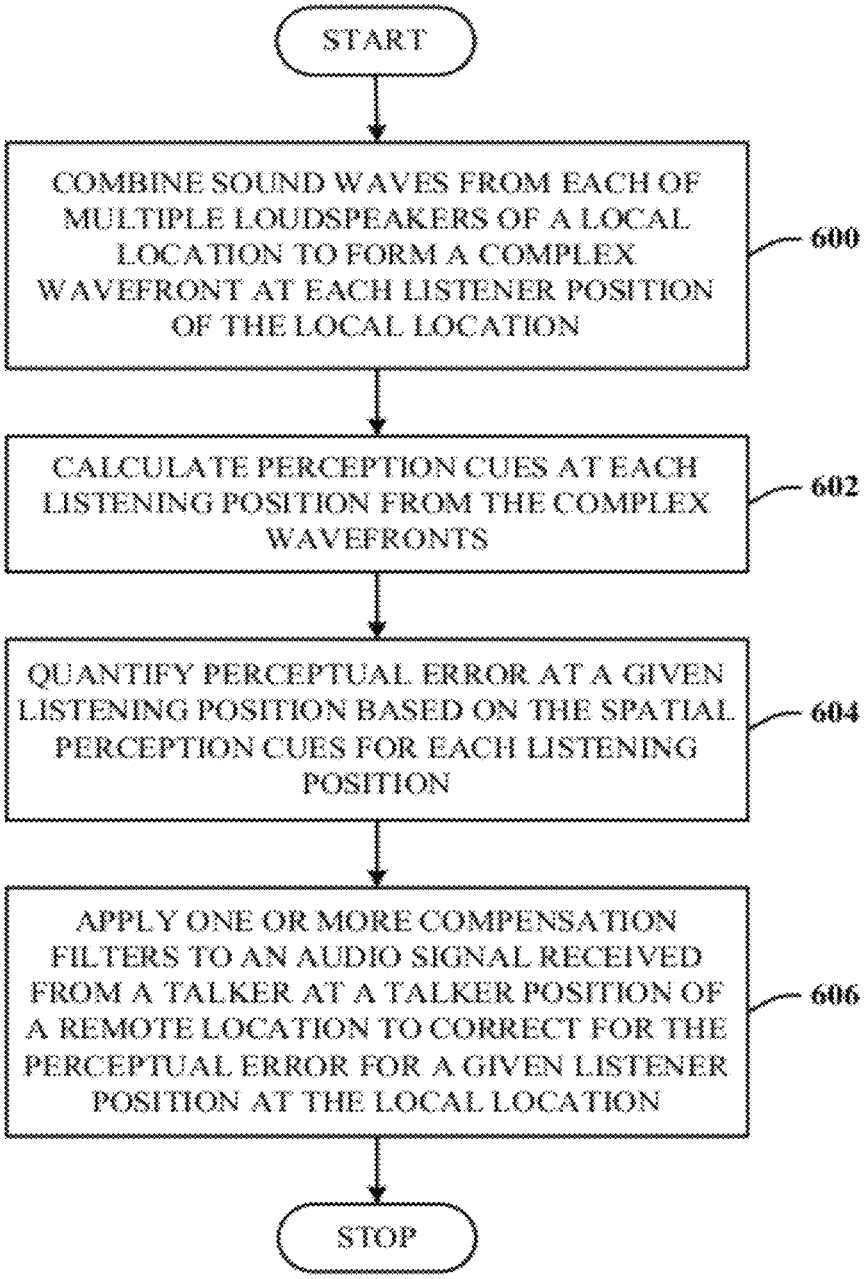
FIG. 6 illustrates a multiparty media processing method in accordance with the disclosed architecture.

FIG. 6 illustrates a multiparty media processing method in accordance with the disclosed architecture. At 600, sound waves from each of multiple loudspeakers of a local location are combined to form a complex wavefront at each listener position of the local location. At 602, spatial perception cues are calculated at each listening position from the complex wavefronts. At 604, perceptual error is quantified at a given listening position based on the spatial perception cues for each listening position. At 606, one or more compensation filters are applied (e.g., in realtime) to an audio signal received from a talker at a talker position of a remote location to correct for the perceptual error for a given listener position at the local location. Note that in one implementation, there can be at least one filter for each loudspeaker.

Figure 7:
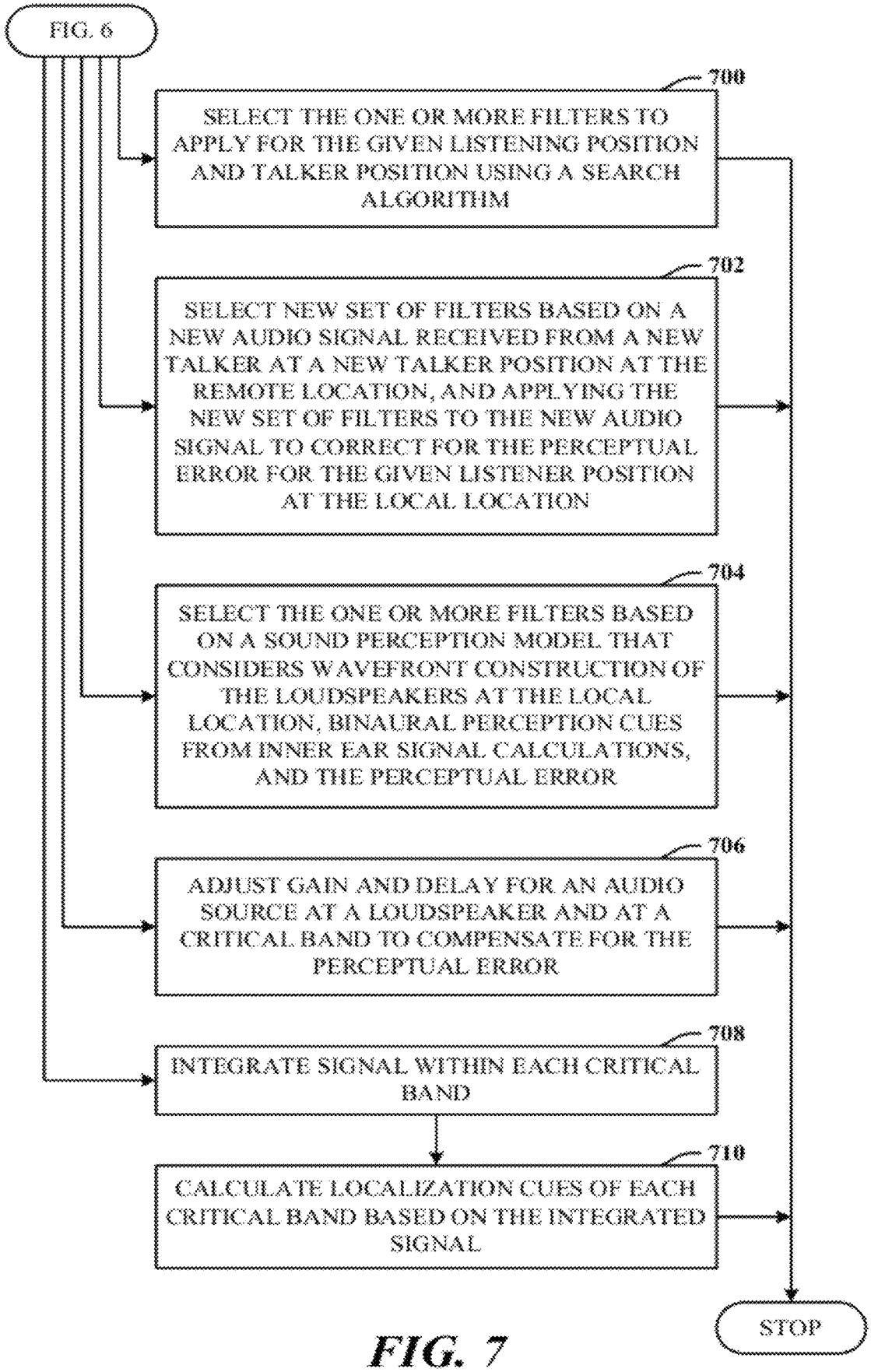
FIG. 7 illustrates further aspects of the method of FIG. 6.

FIG. 7 illustrates further aspects of the method of FIG. 6. Note that the flow indicates that each block can represent a step that can be included, separately or in combination with other blocks, as additional aspects of the method represented by the flow chart of FIG. 6. At 700, the one or more filters are selected to apply for the given listening position and talker position using a search algorithm. At 702, a new set of filters is selected based on a new audio signal received from a new talker at a new talker position at the remote location, and the new set of filters is applied to the new audio signal to correct for the perceptual error for the given listener position at the local location. At 704, the one or more filters are selected based on a sound perception model that considers wavefront construction of the loudspeakers at the local location, binaural perception cues from inner ear signal calculations, and the perceptual error. At 706, gain and delay for an audio source is adjusted at a loudspeaker and at a critical band to compensate for the perceptual error. At 708, a signal is integrated within each critical band. At 710, localization cues are calculated at each critical band based on the integrated signal.

As used in this application, the terms "component" and "system" are intended to refer to a computer-related entity, either hardware, a combination of software and tangible hardware, software, or software in execution. For example, a component can be, but is not limited to, tangible components such as a processor, chip memory, mass storage devices (e.g., optical drives, solid state drives, and/or magnetic storage media drives), and computers, and software components such as a process running on a processor, an object, an executable, a data structure (stored in volatile or non-volatile storage media), a module, a thread of execution, and/or a program. By way of illustration, both an application running on a server and the server can be a component. One or more components can reside within a process and/or thread of execution, and a component can be localized on one computer and/or distributed between two or more computers. The word "exemplary" may be used herein to mean serving as an example, instance, or illustration. Any aspect or design described herein as "exemplary" is not necessarily to be construed as preferred or advantageous over other aspects or designs.

Figure 8:
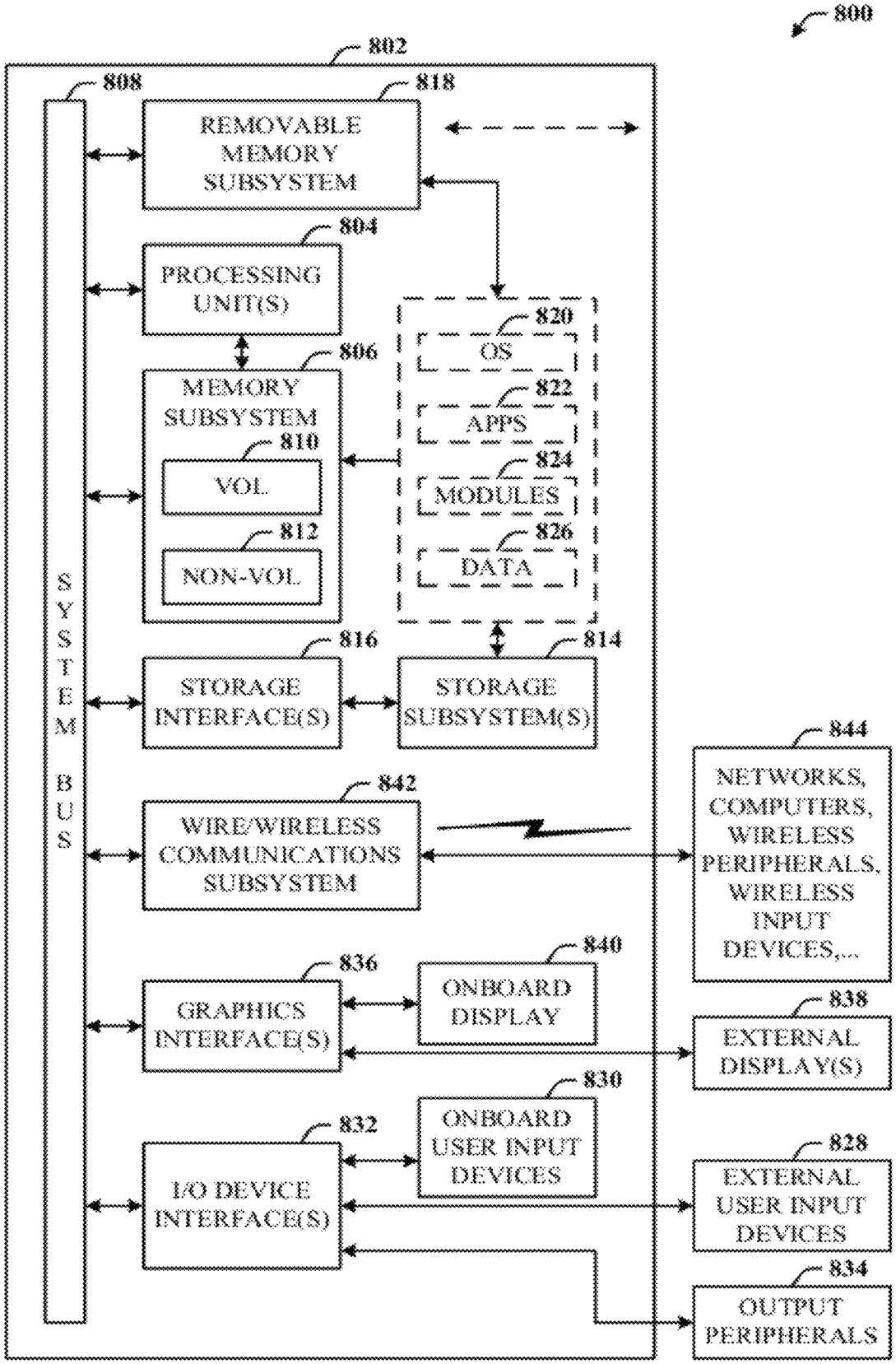
FIG. 8 illustrates a block diagram of a computing system that executes filter optimization and application in accordance with the disclosed architecture.

Referring now to FIG. 8, there is illustrated a block diagram of a computing system 800 that executes filter optimization and application in accordance with the disclosed architecture. In order to provide additional context for various aspects thereof, FIG. 8 and the following description are intended to provide a brief, general description of the suitable computing system 800 in which the various aspects can be implemented. While the description above is in the general context of computer-executable instructions that can run on one or more computers, those skilled in the art will recognize that a novel embodiment also can be implemented in combination with other program modules and/or as a combination of hardware and software.

The computing system 800 for implementing various aspects includes the computer 802 having processing unit(s) 804, a computer-readable storage such as a system memory 806, and a system bus 808. The processing unit(s) 804 can be any of various commercially available processors such as single-processor, multi-processor, single-core units and multi-core units. Moreover, those skilled in the art will appreciate that the novel methods can be practiced with other computer system configurations, including minicomputers, mainframe computers, as well as personal computers (e.g., desktop, laptop, etc.), hand-held computing devices, microprocessor-based or programmable consumer electronics, and the like, each of which can be operatively coupled to one or more associated devices.

The system memory 806 can include computer-readable storage (physical storage media) such as a volatile (VOL) memory 810 (e.g., random access memory (RAM)) and non-volatile memory (NON-VOL) 812 (e.g., ROM, EPROM, EEPROM, etc.). A basic input/output system (BIOS) can be stored in the non-volatile memory 812, and includes the basic routines that facilitate the communication of data and signals between components within the computer 802, such as during startup. The volatile memory 810 can also include a high-speed RAM such as static RAM for caching data.

The system bus 808 provides an interface for system components including, but not limited to, the system memory 806 to the processing unit(s) 804. The system bus 808 can be any of several types of bus structure that can further interconnect to a memory bus (with or without a memory controller), and a peripheral bus (e.g., PCI, PCIe, AGP, LPC, etc.), using any of a variety of commercially available bus architectures.

The computer 802 further includes machine readable storage subsystem(s) 814 and storage interface(s) 816 for interfacing the storage subsystem(s) 814 to the system bus 808 and other desired computer components. The storage subsystem (s) 814 (physical storage media) can include one or more of a hard disk drive (HDD), a magnetic floppy disk drive (FDD), and/or optical disk storage drive (e.g., a CD-ROM drive DVD drive), for example. The storage interface(s) 816 can include interface technologies such as EIDE, ATA, SATA, and IEEE 1394, for example.

One or more programs and data can be stored in the memory subsystem 806, a machine readable and removable memory subsystem 818 (e.g., flash drive form factor technology), and/or the storage subsystem(s) 814 (e.g., optical, magnetic, solid state), including an operating system 820, one or more application programs 822, other program modules 824, and program data 826.

The one or more application programs 822, other program modules 824, and program data 826 can include the entities and components of the system 100 of FIG. 1, the entities and components of the diagram 200 of FIG. 2, the process 300 of FIG. 3, the model 400 of FIG. 4, the entities and components of the diagram 500 of FIG. 5, and the methods represented by the flowcharts of FIGS. 6 and 7, for example.

Generally, programs include routines, methods, data structures, other software components, etc., that perform particular tasks or implement particular abstract data types. All or portions of the operating system 820, applications 822, modules 824, and/or data 826 can also be cached in memory such as the volatile memory 810, for example. It is to be appreciated that the disclosed architecture can be implemented with various commercially available operating systems or combinations of operating systems (e.g., as virtual machines).

The storage subsystem(s) 814 and memory subsystems (806 and 818) serve as computer readable media for volatile and non-volatile storage of data, data structures, computer-executable instructions, and so forth. Such instructions, when executed by a computer or other machine, can cause the computer or other machine to perform one or more acts of a method. The instructions to perform the acts can be stored on one medium, or could be stored across multiple media, so that the instructions appear collectively on the one or more computer-readable storage media, regardless of whether all of the instructions are on the same media.

Computer readable media can be any available media that can be accessed by the computer 802 and includes volatile and non-volatile internal and/or external media that is removable or non-removable. For the computer 802, the media accommodate the storage of data in any suitable digital format. It should be appreciated by those skilled in the art that other types of computer readable media can be employed such as zip drives, magnetic tape, flash memory cards, flash drives, cartridges, and the like, for storing computer executable instructions for performing the novel methods of the disclosed architecture.

A user can interact with the computer 802, programs, and data using external user input devices 828 such as a keyboard and a mouse. Other external user input devices 828 can include a microphone, an IR (infrared) remote control, a joystick, a game pad, camera recognition systems, a stylus pen, touch screen, gesture systems (e.g., eye movement, head movement, etc.), and/or the like. The user can interact with the computer 802, programs, and data using onboard user input devices 830 such a touchpad, microphone, keyboard, etc., where the computer 802 is a portable computer, for example. These and other input devices are connected to the processing unit(s) 804 through input/output (I/O) device interface(s) 832 via the system bus 808, but can be connected by other interfaces such as a parallel port, IEEE 1394 serial port, a game port, a USB port, an IR interface, short-range wireless (e.g., Bluetooth) and other personal area network (PAN) technologies, etc. The I/O device interface(s) 832 also facilitate the use of output peripherals 834 such as printers, audio devices, camera devices, and so on, such as a sound card and/or onboard audio processing capability.

One or more graphics interface(s) 836 (also commonly referred to as a graphics processing unit (GPU)) provide graphics and video signals between the computer 802 and external display(s) 838 (e.g., LCD, plasma) and/or onboard displays 840 (e.g., for portable computer). The graphics interface(s) 836 can also be manufactured as part of the computer system board.

The computer 802 can operate in a networked environment (e.g., IP-based) using logical connections via a wired/wireless communications subsystem 842 to one or more networks and/or other computers. The other computers can include workstations, servers, routers, personal computers, microprocessor-based entertainment appliances, peer devices or other common network nodes, and typically include many or all of the elements described relative to the computer 802. The logical connections can include wired/wireless connectivity to a local area network (LAN), a wide area network (WAN), hotspot, and so on. LAN and WAN networking environments are commonplace in offices and companies and facilitate enterprise-wide computer networks, such as intranets, all of which may connect to a global communications network such as the Internet.

When used in a networking environment the computer 802 connects to the network via a wired/wireless communication subsystem 842 (e.g., a network interface adapter, onboard transceiver subsystem, etc.) to communicate with wired/wireless networks, wired/wireless printers, wired/wireless input devices 844, and so on. The computer 802 can include a modem or other means for establishing communications over the network. In a networked environment, programs and data relative to the computer 802 can be stored in the remote memory/storage device, as is associated with a distributed system. It will be appreciated that the network connections shown are exemplary and other means of establishing a communications link between the computers can be used.

The computer 802 is operable to communicate with wired/wireless devices or entities using the radio technologies such as the IEEE 802.xx family of standards, such as wireless devices operatively disposed in wireless communication (e.g., IEEE 802.11 over-the-air modulation techniques) with, for example, a printer, scanner, desktop and/or portable computer, personal digital assistant (PDA), communications satellite, any piece of equipment or location associated with a wirelessly detectable tag (e.g., a kiosk, news stand, restroom), and telephone. This includes at least Wi-Fi (or Wireless Fidelity) for hotspots, WiMax, and Bluetooth™ wireless technologies. Thus, the communications can be a predefined structure as with a conventional network or simply an ad hoc communication between at least two devices. Wi-Fi networks use radio technologies called IEEE 802.11x (a, b, g, etc.) to provide secure, reliable, fast wireless connectivity. A Wi-Fi network can be used to connect computers to each other, to the Internet, and to wire networks (which use IEEE 802.3-related media and functions).

What has been described above includes examples of the disclosed architecture. It is, of course, not possible to describe every conceivable combination of components and/or methodologies, but one of ordinary skill in the art may recognize that many further combinations and permutations are possible. Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A multiparty media processing system, comprising:

an audio input component that receives electrical signals representative of audio from audio sources positioned at a remote location; and a spatializer component that applies compensation filters to the electrical signals to construct sound waves via speakers at a local location, the sound waves provide spatial perception cues of a position of an audio source at the remote location to listeners at the local location, wherein the sound waves are combined to form a complex wavefront at the local location that is used to calculate the spatial perception cues and perceptual error is quantified based on the spatial perception cues for each listener position.

2. The system of claim 1 wherein the compensation filters are computed to consider a frequency dependent reconstructed signal at each listener position.

3. The system of claim 1, wherein the compensation filters are computed to consider perceptual error between an ideal wavefront of sound waves and a reconstructed wavefront of sound waves relative to a given listener position.

4. The system of claim 1, wherein a set of the compensation filters is computed for each audio source for all local listener positions, and a listener perceives a virtual location of the audio source based on the compensation filters.

5. The system of claim 1, wherein one or more of the compensation filters are applied to electronic signals received from a talker at a talker position to correct for the perceptual error calculated at a given listener position.

6. The system of claim 1, wherein the compensation filters are computed to consider binaural perception cues determined from at least one of an interaural time difference or an interaural level difference.

7. The system of claim 1, wherein the spatializer component facilitates modification of a feeding gain and delay for a local speaker to reconstruct the soundwaves for a given listening position.

8. The system of claim 1, further comprising a video presentation component that renders images of talkers captured at the remote location, the images rendered to the listeners at the local location to provide a video perception to the listeners.

9. The system of claim 8, wherein the spatializer component maps the audio perception to the video perception in 3D space, including depth of an audio source.

10. A multiparty media processing system, comprising:

an audio input component that receives electrical signals representative of audio from talkers speaking into audio sources positioned at a remote location;

a spatializer component that applies compensation filters to the electrical signals to construct sound waves via loudspeakers at a local location, the sound waves provide spatial perception cues of a position of an audio source at the remote location to listeners at the local location, wherein the sound waves are combined to form a complex wavefront at the local location that is used to calculate the spatial perception cues and perceptual error is quantified based on the spatial perception cues for each listener position; and a video presentation component that renders images of talkers captured at the remote location, the images rendered to the listeners at the local location to provide a video perception to the listeners, the spatializer component relates the audio perception to the video perception in 3D space, including depth of an audio source, via the compensation filters.

11. The system of claim 10, wherein the compensation filters are computed to consider perceptual error between an ideal wavefront of sound waves and a reconstructed wavefront of sound waves relative to a given listener position.

12. The system of claim 10, wherein the compensation filters are computed to consider binaural perception cues determined from at least one of an interaural time difference or an interaural level difference.

13. The system of claim 10, wherein a compensation filter is optimized based on perceptual modeling of the local location for all local listener positions.

14. The system of claim 10, wherein the spatializer component facilitates modification of a feeding gain and delay for a local speaker to reconstruct the sound waves for a given listening position.

15. A multiparty media processing method, comprising acts of:

combining sounds waves from each of multiple loudspeakers of a local location to form a complex wavefront at each listener position of the local location;

calculating spatial perception cues at each listening position from the complex wavefronts;

quantifying perceptual error at a given listening position based on the spatial perception cues for each listening position; and applying one or more compensation filters to an audio signal received from a talker at a talker position of a remote location to correct for the perceptual error for a given listener position at the local location.

16. The method of claim 15, further comprising selecting the one or more filters to apply for the given listening position and talker position using a search algorithm.

17. The method of claim 15, further comprising selecting a new set of filters based on a new audio signal received from a new talker at a new talker position at the remote location, and applying the new set of filters to the new audio signal to correct for the perceptual error for the given listener position at the local location.

18. The method of claim 15, further comprising selecting the one or more filters based on a sound perception model that considers wavefront construction of the loudspeakers at the local location, binaural perception cues from inner ear signal calculations, and the perceptual error.

19. The method of claim 15, further comprising adjusting gain and delay for an audio source at a loudspeaker and at a critical band to compensate for the perceptual error.

20. The method of claim 15, further comprising:

integrating a signal within each critical band; and calculating localization cues of each critical band based on the integrated signal.

* * * * *